United States Patent [19]

Bretschneider et al.

[11] 4,210,011

[45] Jul. 1, 1980

[54] ROLLING MILL

[75] Inventors: Erich Bretschneider, Meerbusch; Hermann Leitner, Langenfeld; Friedhelm Böhmer, Neuss, all of Fed. Rep. of Germany

[73] Assignee: Schloemann-Siemag AG., Düsseldorf, Fed. Rep. of Germany

[21] Appl. No.: 8,285

[22] Filed: Feb. 1, 1979

Related U.S. Application Data

[63] Continuation of Ser. No. 866,795, Jan. 5, 1978, abandoned, which is a continuation of Ser. No. 796,312, May 12, 1977, abandoned, which is a continuation-in-part of Ser. No. 675,478, Apr. 9, 1976, abandoned, which is a continuation of Ser. No. 567,607, Apr. 14, 1975, abandoned.

[30] Foreign Application Priority Data

Apr. 17, 1974 [DE] Fed. Rep. of Germany ..... 2418453

[51] Int. Cl.[2] ..... B21B 13/12

[52] U.S. Cl. ..... 72/234

[58] Field of Search ..... 72/224, 225, 235, 234; 29/527.7

[56] References Cited

U.S. PATENT DOCUMENTS

| | | | |
|---|---|---|---|
| 2,059,124 | 10/1936 | Layton | 72/224 X |
| 3,643,488 | 2/1972 | Bretschneider | 72/191 |
| 3,735,617 | 5/1973 | Bretschneider | 72/78 |

*Primary Examiner*—Milton S. Mehr

*Attorney, Agent, or Firm*—Norman S. Blodgett; Gerry A. Blodgett

[57] ABSTRACT

Process and apparatus for the rolling of rod or light-section steel by the use of a cluster-roll stand and a planetary, diagonal rolling stand, having angularly arranged rolls.

4 Claims, 8 Drawing Figures

ROLLING MILL

CROSS-REFERENCE TO RELATED APPLICATIONS

This application is a continuation of application Ser. No. 866,795 filed Jan. 5, 1978, abandoned, which is a continuation of application Ser. No. 796,312 filed May 12, 1977, abandoned, which is a continuation-in-part of application Ser. No. 675,478 filed Apr. 9, 1976, abandoned, which is a continuation of application Ser. No. 567,607 filed Apr. 14, 1975, abandoned.

BACKGROUND OF THE INVENTION

The type of a one-frame planetary, diagonal rolling stand built in accordance with German Pat. No. 1,602,153 or U.S. Pat. No. 3,735,617 makes it possible, in the rolling of rod or light-section steel, to replace a complete roll line within the rod or light-section rolling mill train and to achieve in one rolling pass a considerable reduction in cross-section. This stand construction has made it possible to reduce considerably the plant expenditure for a rod or light-section steel train and also to reduce considerably the size of shed necessary for the housing of the rod and the light-section steel mill train. Commonly-used rod or light-section steel rolling mill trains usually use square-shaped billets as a raw material, these billets being gradually reduced to a circular cross-section by a large number of successive rolling passes. When using a planetary diagonal rolling mill in place of a complete preparation (break-down) line for the rod or light-section steel, the use of square billets as raw material leads to certain difficulties. This is because the lead end of the rod leaving the planetary diagonal rolling mill leaves as round stock, because of its peculiar mode of operation. The difficulties are mainly related to the fact that, during the initial rolling of a square bar, its corner areas are subjected to a considerably greater "working" during deformation than the other zones of the cross-section. This means that different material expansion takes place within the cross-section which influences the quality of the finished product disadvantageously.

From this it can be clearly understood that using round billets as raw material for rod or light-section steel rolling trains permit the roughing train to be replaced with a single-stand, planetary, diagonal rolling mill, because on that case the planetary diagonal rolling mill only has to cope with a cross-sectional reduction, but not with a cross-sectional deformation. Therefore, efficiency of a planetary diagonal rolling mill (that is, its operational safety and its degree of elongation) is considerably better in the rolling round raw stock than in the rolling of square cross-section billets.

In most steel mills, however, round bar stock is not always readily available in sufficient quantities, so that, as a practical matter, the replacement of a multi-stand roughing train in a rod or light-section steel rolling mill with a single-stand, planetary, diagonal rolling stand presents insurmountable difficulties. In order to fabricate round milling stock for use as a raw material, a complete new milling program must be created. These and other difficulties experienced with the prior art devices have been obviated in a novel manner by the present invention.

It is, therefore, an outstanding object of the invention to provide a rolling mill which eliminates many of the difficulties experienced in the past in a simple way and with small expenditure.

Another object of this invention is the provision of a process which uses octagonal cross-section billets and eliminates all difficulties and disadvantages, when these bars are subsequently treated in a planetary diagonal rolling stand.

It is another object of the instant invention to provide a process using octagonal cross-sections during rolling on a planetary diagonal rolling stand, whereby results are obtained equal to those that are achieved by the rolling of circular cross-section stock as the raw material.

With these and other objects in view, as will be apparent to those skilled in the art, the invention resides in the combination of parts set forth in the specification and covered by the claims appended hereto.

SUMMARY OF THE INVENTION

In general, the present invention relates to a simple procedure for the formation of octagonal cross-sectional stock for use as a raw material for rolling in a planetary diagonal rolling stand. This invention consists of the fact that a square billet is stretch-reduced in a simple rolling pass over the four corners. At the same time, starting from each of these corners, over a width substantially equal to half a side area, it is compression deformed into a side area slope of 135°. The result is that the stretch reduction and rearward deformation of the square stock is always twisted 90° into two form zones positioned in the same plane and around the rolling axis in the direction of movement. The result is a three-dimensional deformation by which the core of the deformed rolling stock is placed only under compression, but no tensile stress is present. This is especially important when the square stock to be worked on is formed by the extrusion procedure. Such extruded stock often has the disadvantage that it has a porous core which behaves badly under the action of tensile stress. By means of the stretch reduction and compression afforded by the present invention, such a porous core is strengthened and is improved in quality.

More specifically, the invention consists of an apparatus for the fabrication of raw stock with octagonal-shaped cross-section for subsequent rolling in a planetary diagonal rolling mill, which is in accordance with this invention mainly distinguished by the presence of a four-roll deformation stand having a pair of driven rolls and a pair of friction rolls oppositely arranged and displaced by an angle of 90° around the roll axis. The rolls of both pairs are designed as roll discs with an obtuse angle wedge in the form of a triangularly-shaped caliper groove. Together they enclose the rolling axis with a octagonal caliper action.

Furthermore, it has been found to be of advantage to locate the rolls of both roll pairs with a common axis plane and containing gap-type spaces directed toward the rolling axis between their caliper grooves. Because of this roll arrangement, it is possible to bring about deformation results which are particularly good in spite of the fact that the roll caliper enclosed by the four rollers does not form an exactly uniform octagon, but on the contrary has diagonally-opposed small slotted openings in four positions which prohibit an exact corner formation. However, since the bar stock leaving the four-roll deformation stand is only an intermediate product, which is subject to further working, the deviation of the profile shape from the exact octagon cross-section is meaningless, since no disadvantage has been detected in a further working in the planetary diagonal rolling stand.

Since a uniform stretching of the rolling stock is obtained by the use of a four-roll deformation stand directly in front of a planetary diagonal rolling mill this newly-developed arrangement is recommended especially for the rolling of high grade or alloy steel.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
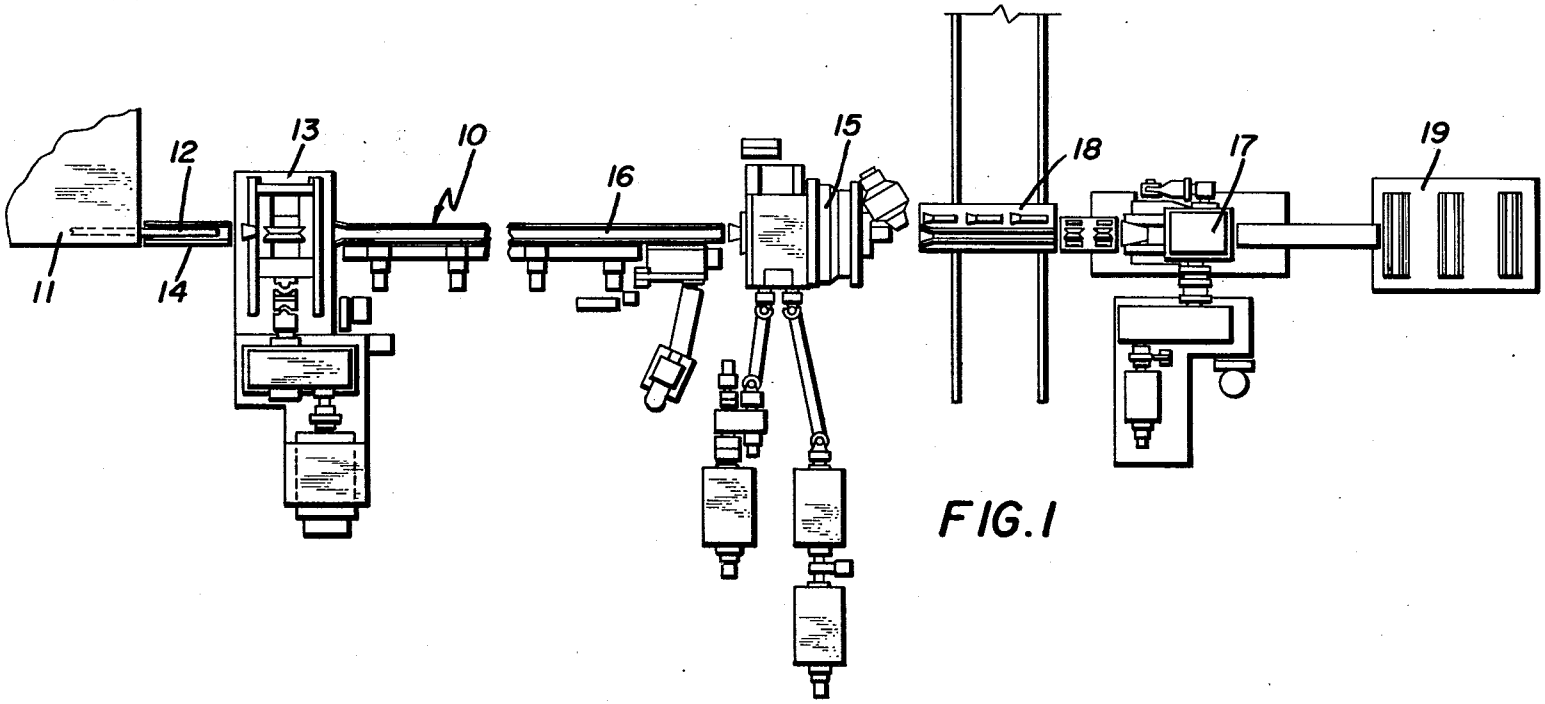
FIG. 1 is a plan view of a rolling mill embodying the principles of the present invention.

Referring first to FIG. 1, wherein are best shown the general features of the invention, it can be seen that the rolling mill, indicated generally by the reference numeral 10, is provided with a furnace 11 for heating billets 12 having a square cross-sectional shape. A primary stand 13 is located adjacent the furnace and receives a billet 12 "on-the-corner". A guide 14 extends between the furnace 11 and the primary stand 13. A secondary stand 15 is located in line with the primary stand and consists of a planetary diagonal rolling mill for converting the billet 12 from the octagonal cross-sectional shape to a circular cross-sectional shape. A conveyor 16 extends between the primary stand 13 and the secondary stand 15. Following the secondary stand 15 is a guide 18 leading to a shear 17 whose output is carried on to a run-out conveyor 19.

Figure 2:
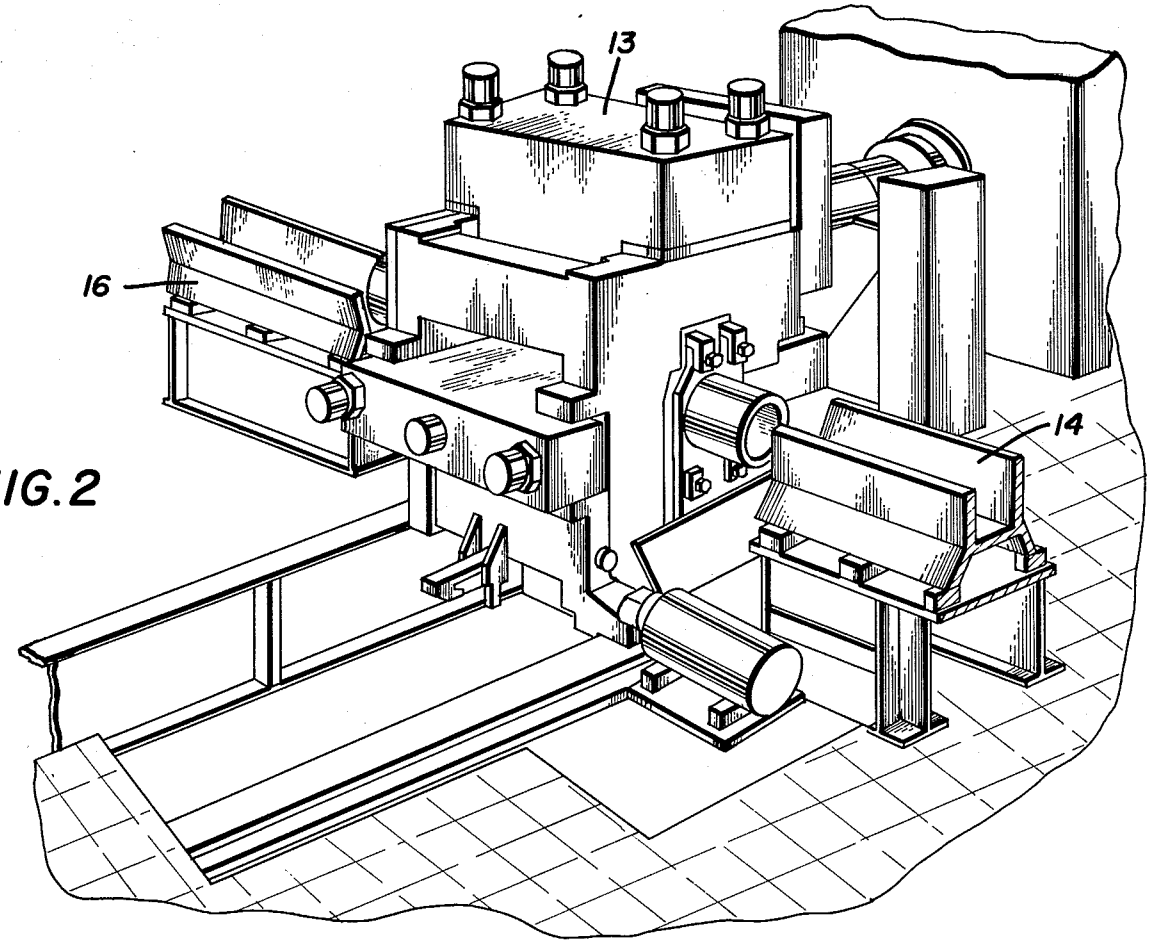
FIG. 2 is a perspective view of a stand forming part of the rolling mill.
Figure 3:
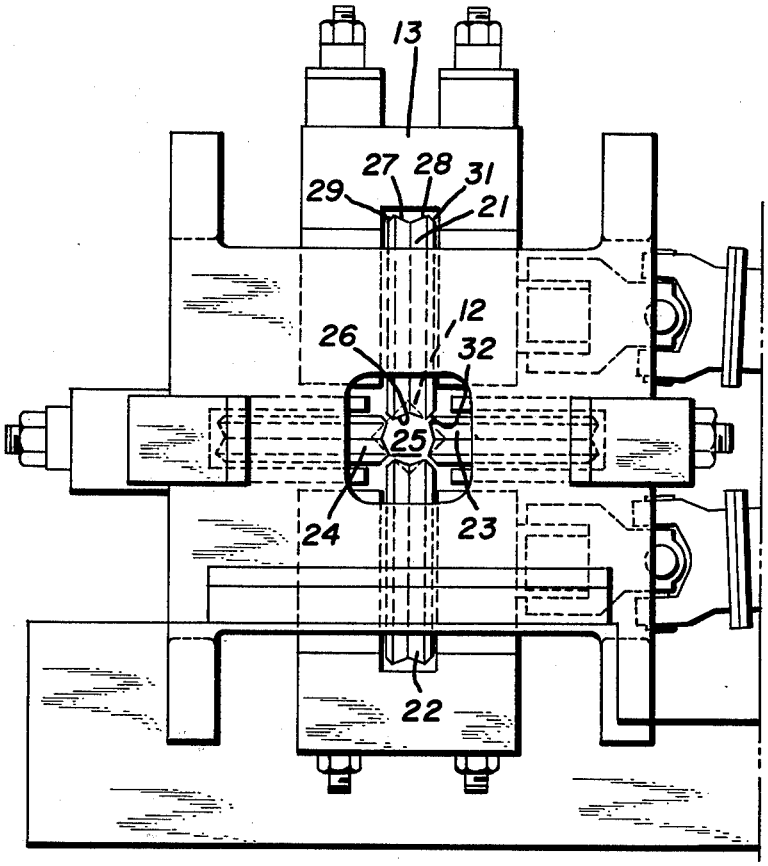
FIG. 3 is a front elevational view of the stand shown in FIG. 2.
Figure 4:
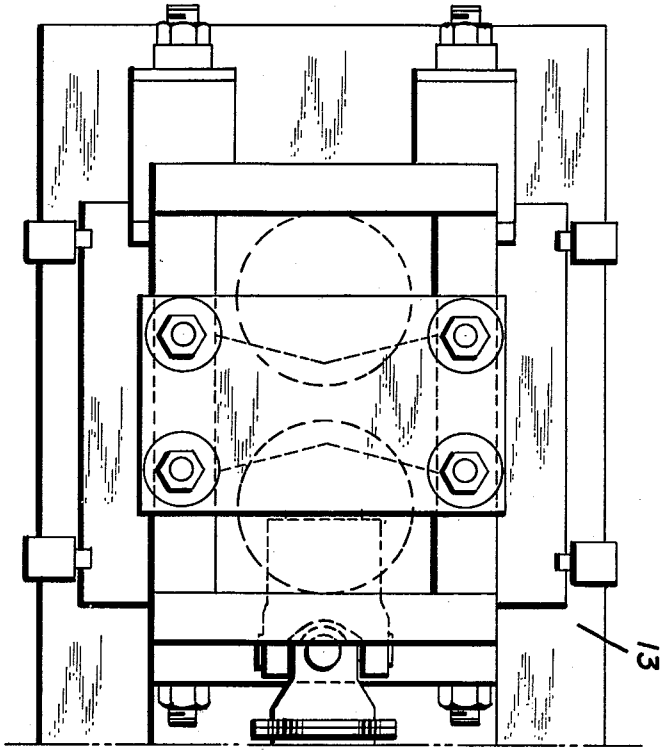
FIG. 4 is a plan view of a portion of the stand shown in FIG. 2.
Figure 5:
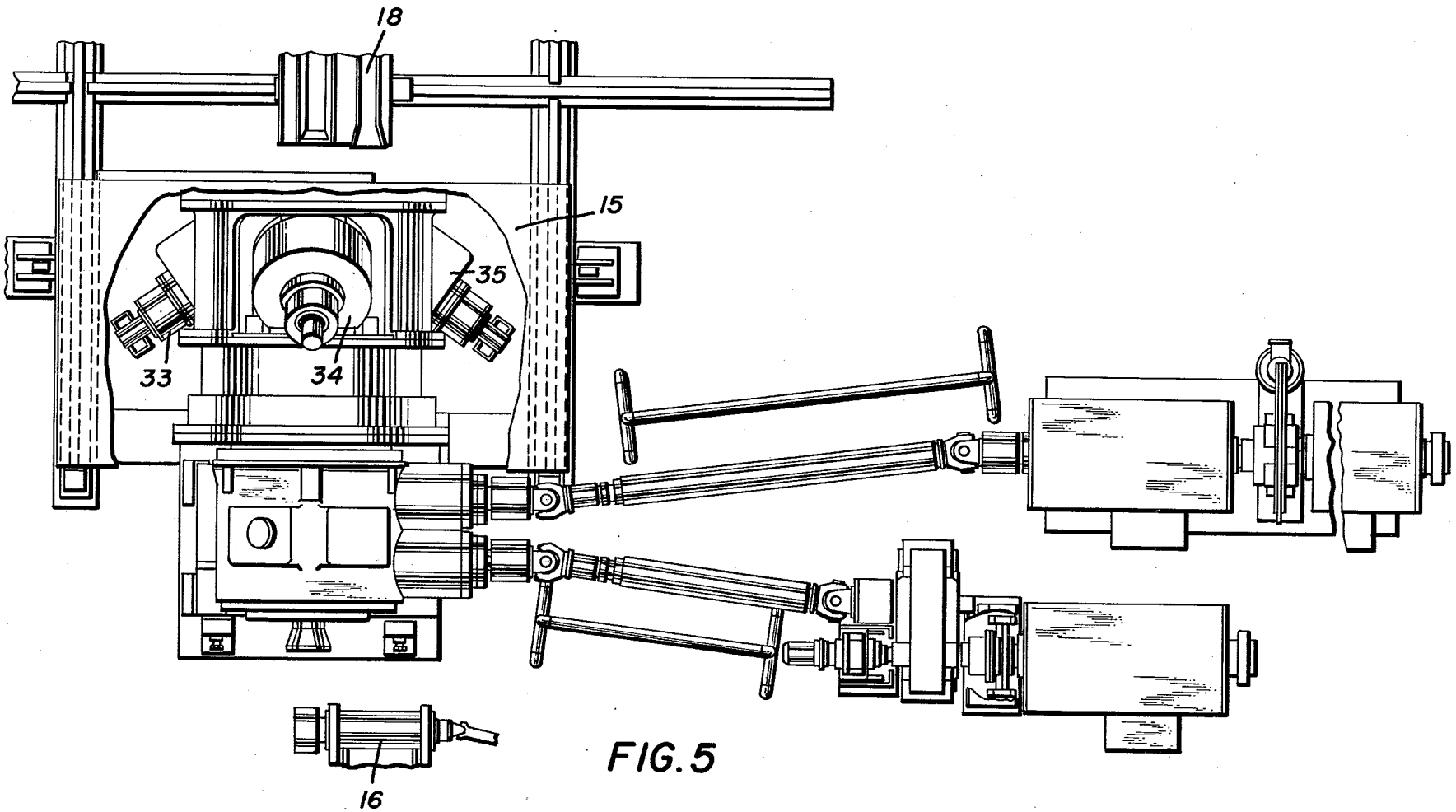
FIG. 5 is an enlarged plan view of another stand forming part of the rolling mill.
Figure 6:
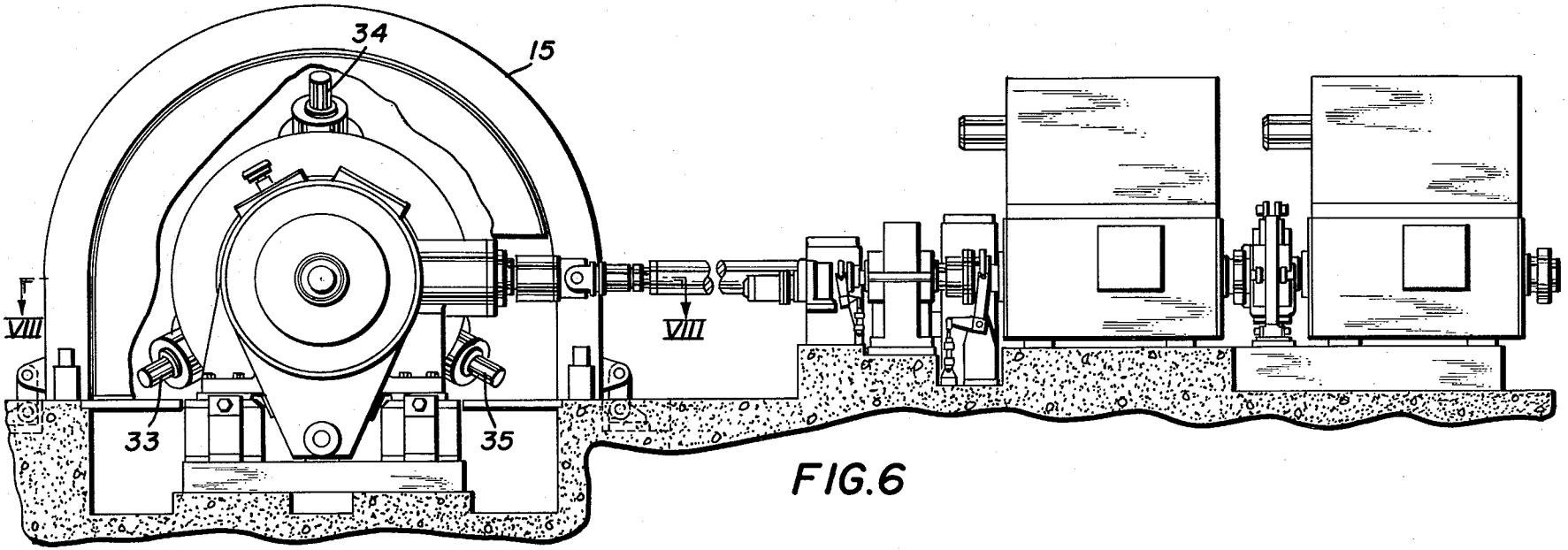
FIG. 6 is a front elevational view of the stand shown in FIG. 5.
Figure 7:
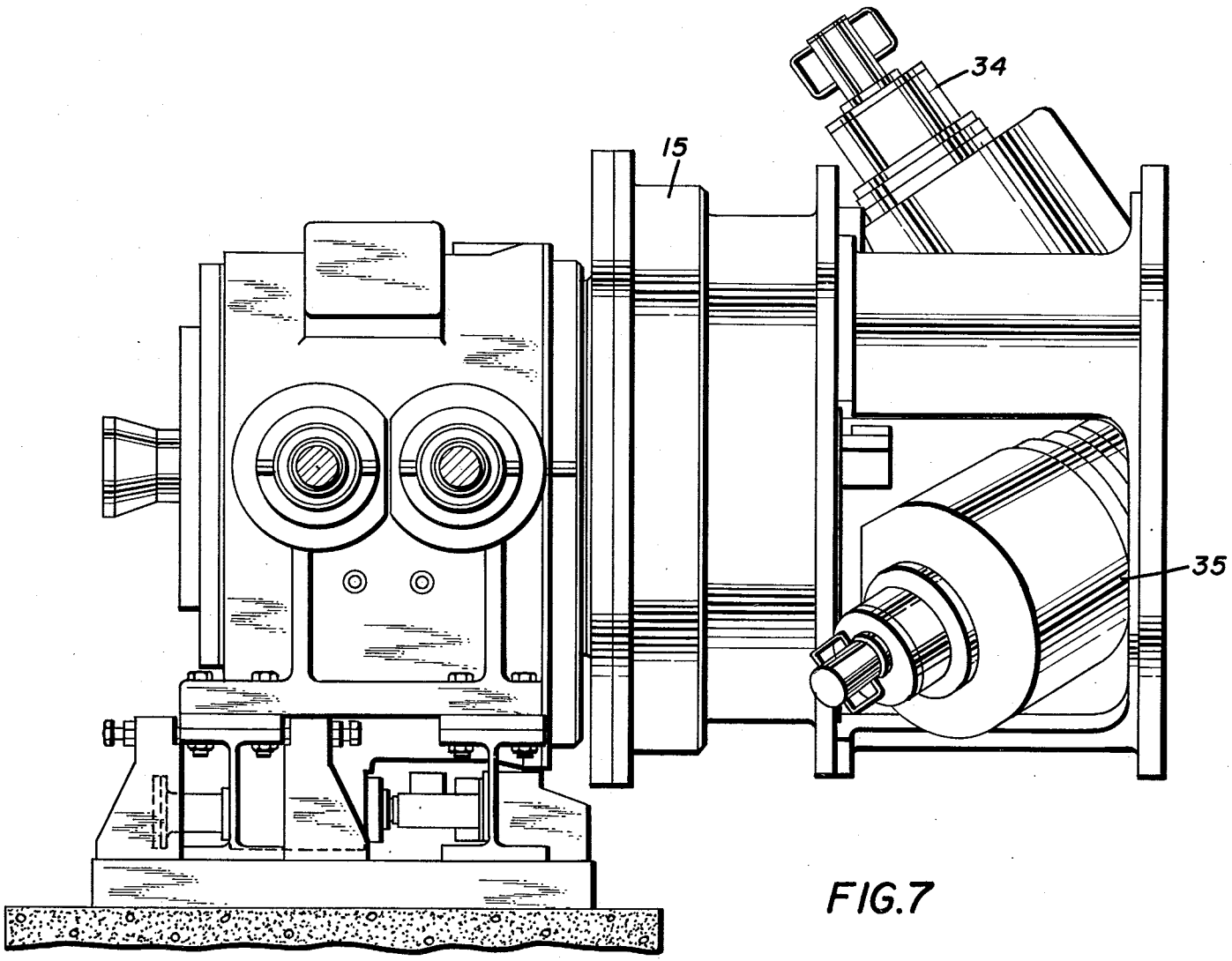
FIG. 7 is a side elevational view of the stand shown in FIG. 5.
Figure 8:
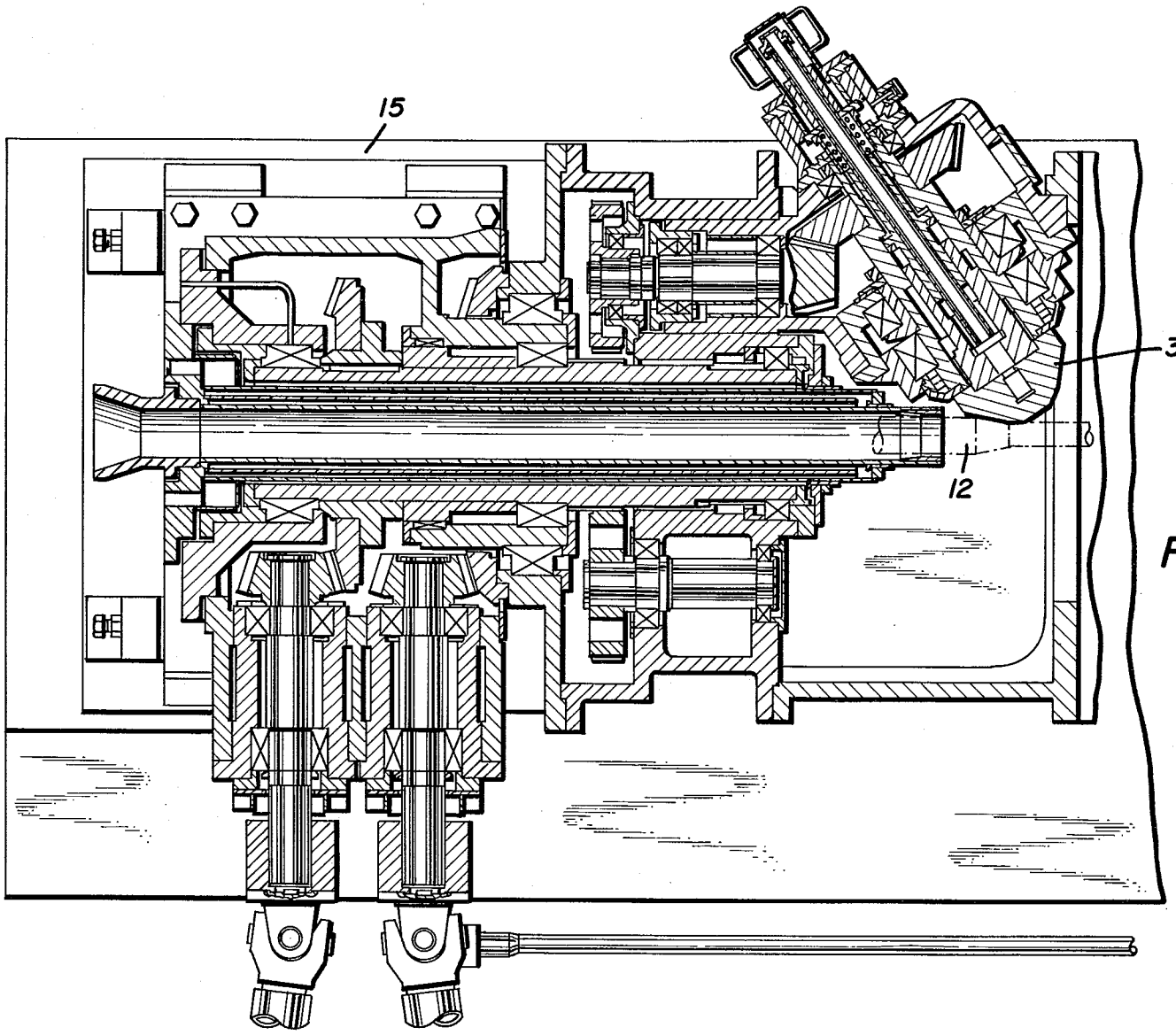
FIG. 8 is a horizontal sectional view of the stand, taken on the line VIII—VIII of FIG. 6.

FIGS. 2, 3, and 4 show the details of the primary stand 13. The primary stand has a first pair of rolls 21 and 22 mounted for rotation about spaced, parallel hoizontal axes and has a second pair of rolls 23 and 24 mounted for rotation about spaced, parallel vertical axes. The peripheries of the four rolls are grouped to form a roll pass 25 that converts the billet from its square cross-sectional shape (on-the-corner) to an octagonal cross-sectional shape. The rolls of the primary stand are in the form of discs with narrow peripheries, each periphery being formed with a groove defined by two oppositely-directed frusto-conical surfaces; for instance, the roll 21 is typical in that its groove 26 is formed by means of two conical surfaces 27 and 28 which are frusto-conical in nature with their smaller ends joined in the centerline of the roll. The conical surfaces come together to form an angle of 135°. Rolls 22, 23, and 24 are similarly formed. The edges of all of the rolls are beveled in the same manner as roll 21 which has bevels 29 and 31 extending at 45° to the roll axis. The bevels of adjacent 90°-related rolls provided a narrow slot-like space 32 between the rolls.

FIGS. 5, 6, 7, and 8 show the details of the secondary stand 15. This stand is of the type shown and described in the patent of Bretschneider No. 3,735,617 and the patent to Leitner No. 3,718,020 and is provided with three rolls 33, 34, and 35. The axes of these rolls are grouped around the roll pass and the rolls have conical faces which engage the stock. These rolls not only rotate about their own angular axes, but they are also rotated together about the stock to convert the billet 14 from the octagonal cross-sectional shape to a circular cross-sectional shape, while attenuating the stock.

The operation of the invention will now be readily understood in view of the above description. The billets 12 of the square cross-section are heated in the furnace 11 and emerge on the conveyor 14 and are supported and conveyed toward the entrance to the primary stand 13 on the corner. The billet enters and passes through the roll pass 25 and the square on-the-corner is converted to an octagon. In other words, the first step provided by the primary stand 13 is to transform the cross-section of a billet from square to round, the square cross-section having four corners and four sides, each side having two half-sides and each corner having two adjacent half-sides.

The primary stand 15 transforms the cross-section from square to octagonal by reducing the billet by stretch reduction over the four corners in a single rolling pass, and at the same time deforming the billet by compression deformation from each corner over the half-side area width to a side area slope of 135°. The billet (which now has an octagonal cross-section) is carried by the conveyor 16 to the entrance to the secondary stand 15, where the billet is exposed to rolling on a planetary diagonal rolling mill to transform the cross-section from octagonal to round. The stretch reduction and compression deformation of the square billet is made in two forming zones positioned in the same horizontal plane and twisted relative to each other by 90° around the roll axis and in the direction of action. It can be seen that in the primary stand only four diagonally-opposed corner areas are exactly formed by their contact with the grooves of the roll, but that the other four diagonal-opposed corner areas do not receive such an exact shape. Such inaccuracies, however, are without any meaning as a practical matter, because they are formed from the square billet-shape into the octagonal cross-section without interruption and, according to the present invention, simply used as raw material for the further rolling on the planetary diagonal rolling mill.

It should be mentioned that, by use of the present invention concept, the rolling of rod or light-section steel from square billets, which was previously accomplished by the use of a six-stand conventional separate pre-roll line, is made possible using only a single stand planetary diagonal rolling mill in the manner shown and described in the patent of Bretschneider et al No. 3,930,395 based on patent application Ser. No. 567,608, filed on Apr. 14, 1975. This is true, in spite of the fact that it had always been felt that such a planetary diagonal rolling mill could be used only when billets with circular cross-section were provided as raw material. Such round billets require fabrication from the square bias stock by means of a two- or three-stand shaping-arrangement. According to the present invention, such as a conventional shaping-arrangement is replaced by the special shaping stand 13. This combination of shaping stand and planetary diagonal rolling mill, according to the present invention, makes it possible with a minimum of cost to operate a rod or light-section rolling mill with fairly large basic cross-sections (up to 200 millimeters) without intermediate heating, or equalization furnaces, or intermediate storage to achieve high production, efficiency, and large bundle weights.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Rolling mill, comprising:

(a) a furnace for heating billets having a square cross-sectional shape, (b) a primary stand located adjacent the furnace for receiving a billet on-the-corner, the primary stand having a first pair of rolls with horizontal axes and having a second pair of rolls with vertical axes, at least one of said pair of rolls being rotatably driven, the peripheries of all four rolls being grouped to form a roll pass that converts the billet from its square cross-sectional shape to an octagonal cross-sectional shape, the rolls of the primary stand being in the form of discs with narrow peripheries, each periphery being formed with a V-shaped groove having an angle of 135°, the edges of all rolls being beveled to provide a narrow slot-like space between adjacent, 90°-related rolls, and (c) a secondary stand located in line with the primary stand, the secondary stand consisting of a planetary diagonal rolling mill including rolls which are driven independently of the driven rolls of said primary stand for converting the billet from the octagonal cross-sectional shape to a circular cross-sectional shape.

2. Rolling mill as recited in claim 1, wherein the rolls of the primary stand are in the form of oppositely-directed, frusto-conical surfaces whose smaller ends join to form said V-shaped groove.

3. Rolling mill as recited in claim 1, wherein a conveyor extends between the primary stand and the secondary stand.

4. Rolling mill as recited in claim 1, comprising:

(a) a shear in line with and spaced from the exit end of the secondary stand, and (b) a conveyor extending between the secondary stand and the shear.

* * * * *